US009768544B2

(12) United States Patent
Du et al.

(10) Patent No.: US 9,768,544 B2
(45) Date of Patent: Sep. 19, 2017

(54) CONNECTOR WITH WATERPROOF STRUCTURE

(71) Applicant: FOXCONN INTERCONNECT TECHNOLOGY LIMITED, Grand Cayman (KY)

(72) Inventors: Xiao-Bo Du, Kunshan (CN); Chun-Ming Yu, Kunshan (CN); Guo-Hua Zhang, Kunshan (CN); Bin Guo, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/382,602

(22) Filed: Dec. 17, 2016

(65) Prior Publication Data

US 2017/0179634 A1 Jun. 22, 2017

(30) Foreign Application Priority Data

Dec. 18, 2015 (CN) ..... 2015 2 1058838 U

(51) Int. Cl.

| | |
|---|---|
| ***H01R 24/00*** | (2011.01) |
| ***H01R 13/52*** | (2006.01) |
| ***H01R 13/6581*** | (2011.01) |
| ***H01R 24/60*** | (2011.01) |
| *H01R 107/00* | (2006.01) |

(52) U.S. Cl.

CPC ..... *H01R 13/521* (2013.01); *H01R 13/6581* (2013.01); *H01R 24/60* (2013.01); *H01R 2107/00* (2013.01)

(58) Field of Classification Search

CPC ..... H01R 23/00; H01R 24/60; H01R 24/62
USPC ..... 439/589, 660, 936, 607.4
See application file for complete search history.

(56) References Cited

U.S. PATENT DOCUMENTS

| | | | | |
|---|---|---|---|---|
| 7,717,717 | B1 * | 5/2010 | Lai | H01R 13/64 439/66 |
| 8,801,463 | B2 * | 8/2014 | Tan | H01R 13/5202 439/607.04 |
| 8,827,742 | B2 * | 9/2014 | Wang | H01R 24/68 439/569 |
| 9,197,104 | B2 * | 11/2015 | Madsen | H02K 1/20 |
| 9,278,365 | B2 * | 3/2016 | Banco | B05B 7/2491 |
| 9,379,499 | B2 * | 6/2016 | Miyoshi | H01R 24/60 |
| 9,385,481 | B2 * | 7/2016 | Chung | H01R 13/6581 |
| 9,553,410 | B2 * | 1/2017 | Zhao | H01R 13/6581 |
| 2014/0113497 | A1 * | 4/2014 | Wang | H01R 13/52 439/660 |
| 2016/0104957 | A1 * | 4/2016 | Kim | H01R 13/6581 439/78 |

* cited by examiner

*Primary Examiner* — Phuong Dinh
(74) *Attorney, Agent, or Firm* — Wei Te Chung; Ming Chieh Chang

(57) ABSTRACT

An electrical connector includes an insulative housing and a plurality of contacts retained in the housing to commonly form a terminal module, a metallic shield enclosing the terminal module and forming a mating cavity, and a glue groove formed in a base of the housing and located behind the mating cavity, in which a glue part is received. The shield forms an opening communicating with the glue groove, through which the liquid type glue is injected into the glue groove and solidified therein.

4 Claims, 10 Drawing Sheets

CONNECTOR WITH WATERPROOF STRUCTURE

BACKGROUND OF THE INVENTION

1. Field of the Invention

The present invention relates to an electrical connector, and particularly to an electrical receptacle connector with a reliable waterproof structure thereof.

2. Description of Related Art

The USB (Universal Serial Bus) Type C connector is gradually popularly used in the cellular phone to replace the traditional Micro USB connector. Thus, a waterproof concern is also an important issue for Type C connector. In the traditional Micro USB connector, the corresponding metallic shield encloses a terminal module including an insulative housing/insulator associated with a plurality of contacts, with a cavity behind the housing in the shield wherein a waterproof glue plate is injected into and/or received in the cavity and intimately adhered to the rear face of the housing through which the tails of the contacts rearwardly extend. Notably, during manufacturing the Micro USB connector is required to be intentionally orientated in an mating side-down perpendicular manner to upwardly expose the rear face of the housing for welcoming the liquid glue, and such a rotational operation may complicate the whole process. In addition, the Type C connector has different configurations with regard to the Micron USB connector and requires an additional metallic bracket securing and covering the metallic shield for mounting the whole connector upon the printed circuit board, and even providing a rear shield covering the rear side of the housing for shielding consideration, thus further complicating the whole manufacturing process.

An improved electrical connector with the waterproof function while being easy-made and the corresponding making method, are desired.

SUMMARY OF THE INVENTION

An object of the invention is to provide an easy-making and labor-saving method for an electrical connector with a waterproof function. The electrical connector includes an insulative housing and a plurality of contacts retained in the housing to commonly form a terminal module, a metallic shield enclosing the terminal module and forming a mating cavity, and a glue groove formed in a base of the housing and located behind the mating cavity, in which a glue part is received. The shield forms an opening communicating with the glue groove, through which the liquid type glue is injected into the glue groove and solidified therein.

The housing further includes a tongue portion extending forwardly from the base. The glue groove includes a first groove. Each contact includes a contacting section exposed upon the tongue portion, a retention section retained in the base, and a tail section extending out of the housing wherein a portion of the retention section is exposed in the first groove. The waterproof part includes a first sealing section enclosing the retention sections in the first groove. The glue groove further includes a second groove communicatively surrounding the first groove in an annular manner, and the waterproof part further includes an annular second sealing part received in the second groove to seal circumferential gaps between the housing and the shield. The base includes opposite front and rear faces and an annular exterior face between the front face and the rear face wherein the second groove extends through the annular exterior face. The shield forms a glue opening aligned with a portion of the second groove so as to allow the liquid type glue to enter the glue groove for solidification.

The terminal module includes a metallic shielding plate embedded within the housing and at least partially along the front-to-back direction enclosed by the waterproof part in both the transverse direction and the vertical direction. The housing includes a first insulator and a second insulator assembled to each other, and the contacts include a plurality of first contacts secured to the first insulator and a plurality of second contacts secured to the second insulator. The first groove includes the first receiving slot in the first insulator and the second receiving slot in the second insulator wherein the retention section of the first contact is exposed in the first receiving slot and the retention section of the second contact is exposed in the second receiving slot. The shielding plate has an opening to communicate the first receiving slot with the second receiving slot.

The features of the invention is to have the glue groove is only exposed to an exterior in an upward vertical direction rather than a rearward horizontal direction so as to allow downward injection of the liquid type glue without laborious operation when the connector is oriented in a normal standing status. Also, the glue opening in the metallic shield is further veiled by/under a metallic bracket, which is used to shield and mount the connector upon the printed circuit board, without possible risks of damaging the waterproof part.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
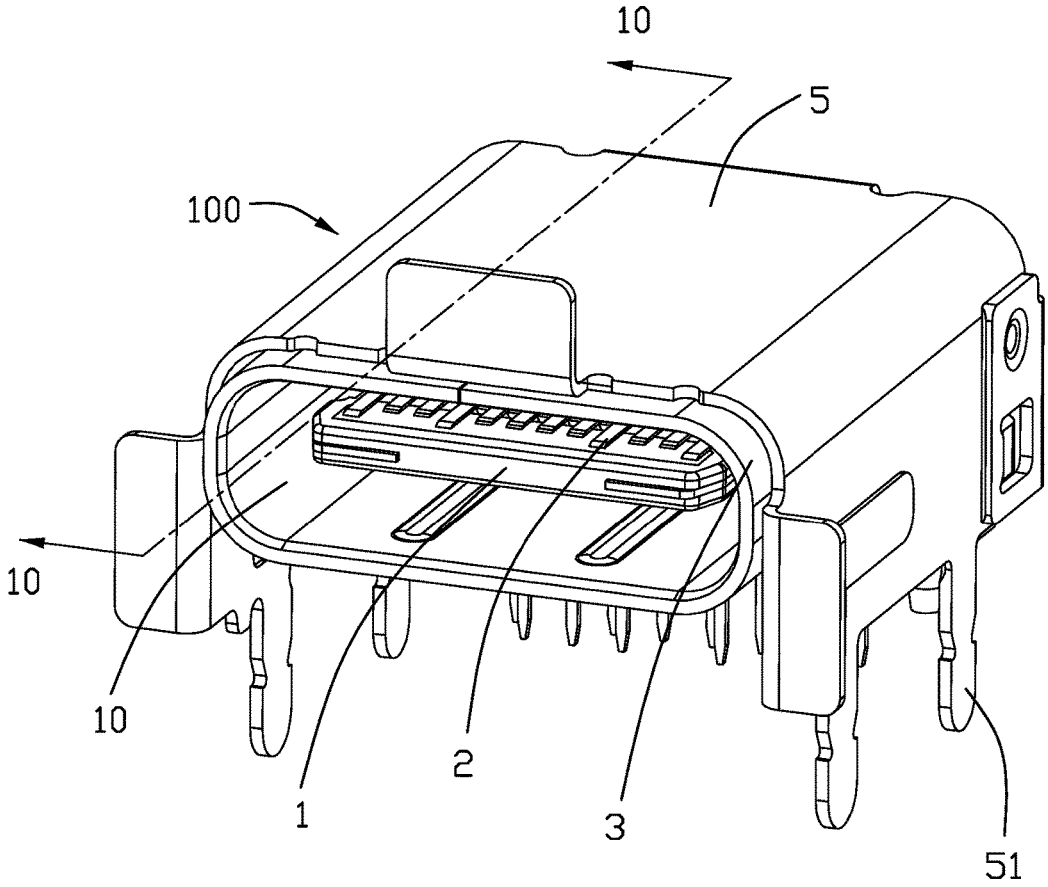
FIG. 1 is a downward assembled perspective view of an electrical connector according to the presently preferred embodiment of the invention.
Figure 2:
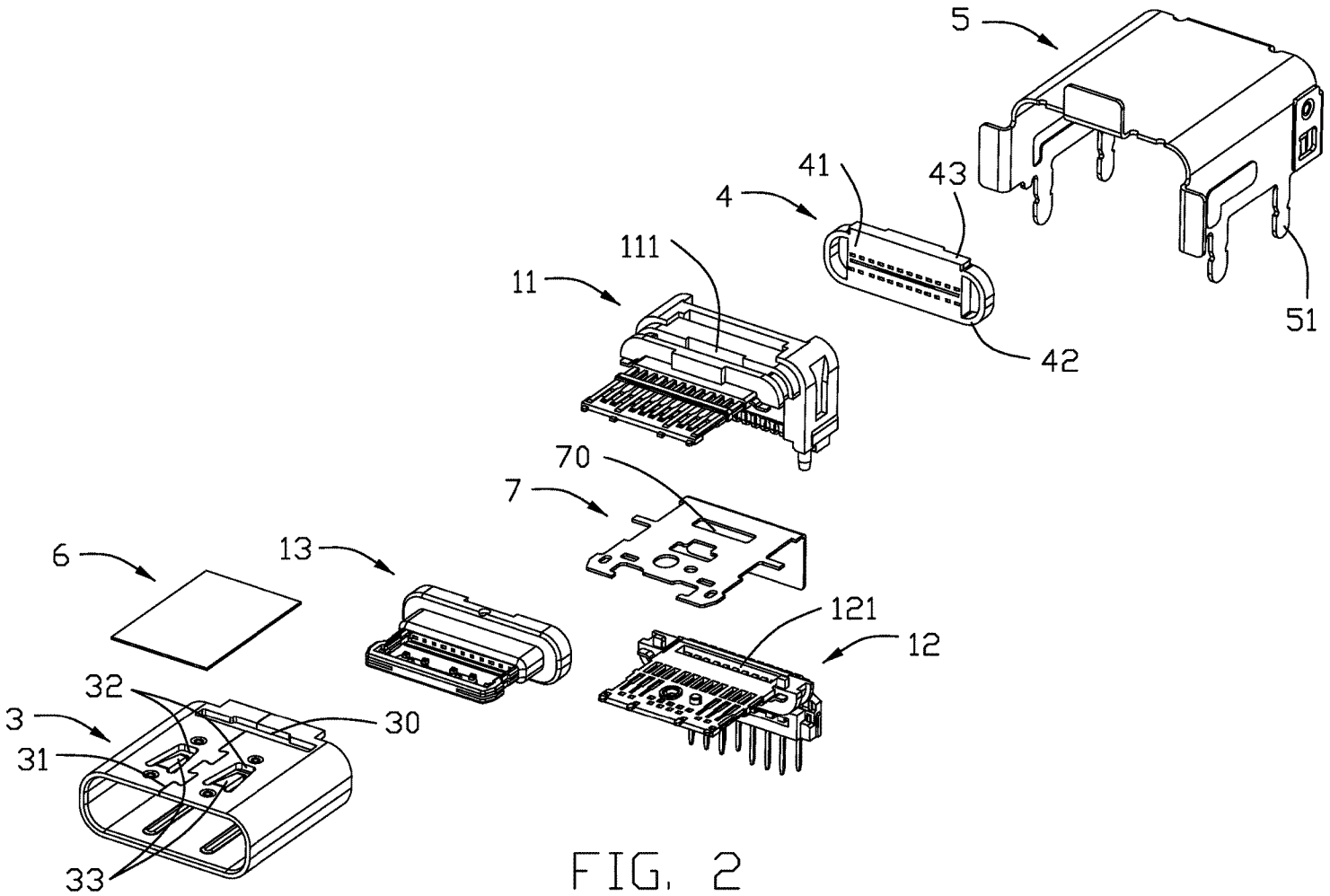
FIG. 2 is a downward exploded perspective view of the electrical connector of FIG. 1.

Referring to FIGS. 1-2, the electrical connector 100 adapted to be mounted to a printed circuit board (not shown), includes an insulative housing 1, a plurality of contacts 2 disposed in the housing 1, and a metallic shielding plate 7 embedded within the insulative housing 1, all of which are commonly form a terminal module 20. A tubular metallic shield 3 encloses the terminal module and forms a mating cavity 10 therein to forwardly communicate with an exterior in a front-to-back direction. A waterproof part 4 is located behind the mating cavity 10. The metallic shielding plate 7 forms a pair of lateral side edges exposed upon the two lateral sides of the housing 1 to form locking notches, respectively.

Figure 3:
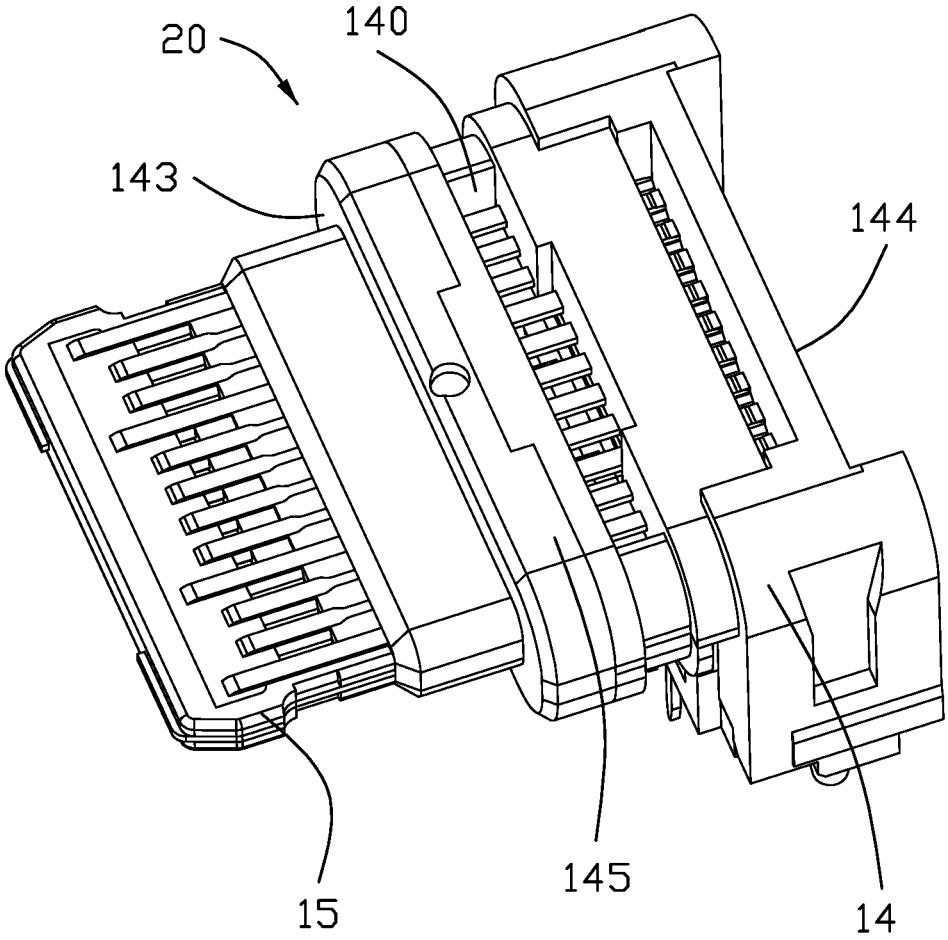
FIG. 3 is a downward assembled perspective view of the terminal module of the electrical connector of FIG. 1.
Figure 4:
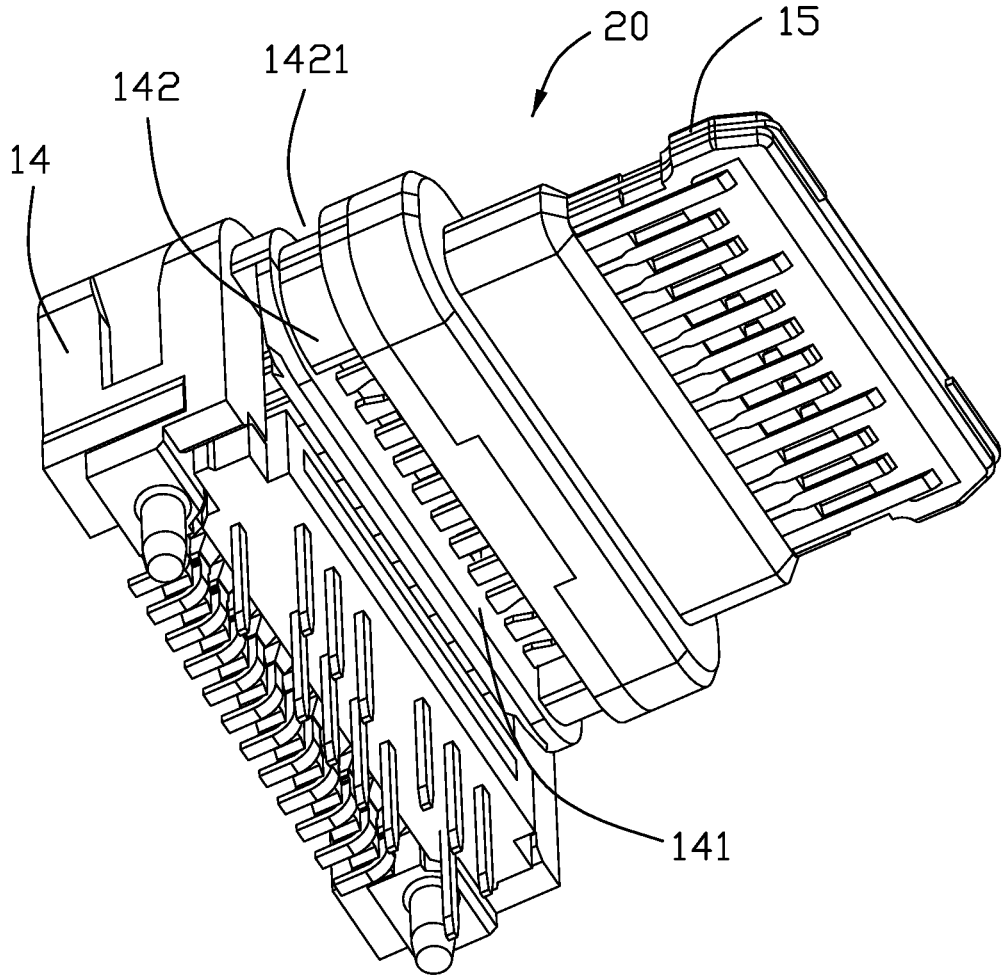
FIG. 4 is an upward assembled perspective view of the electrical connector of FIG. 3.
Figure 9:
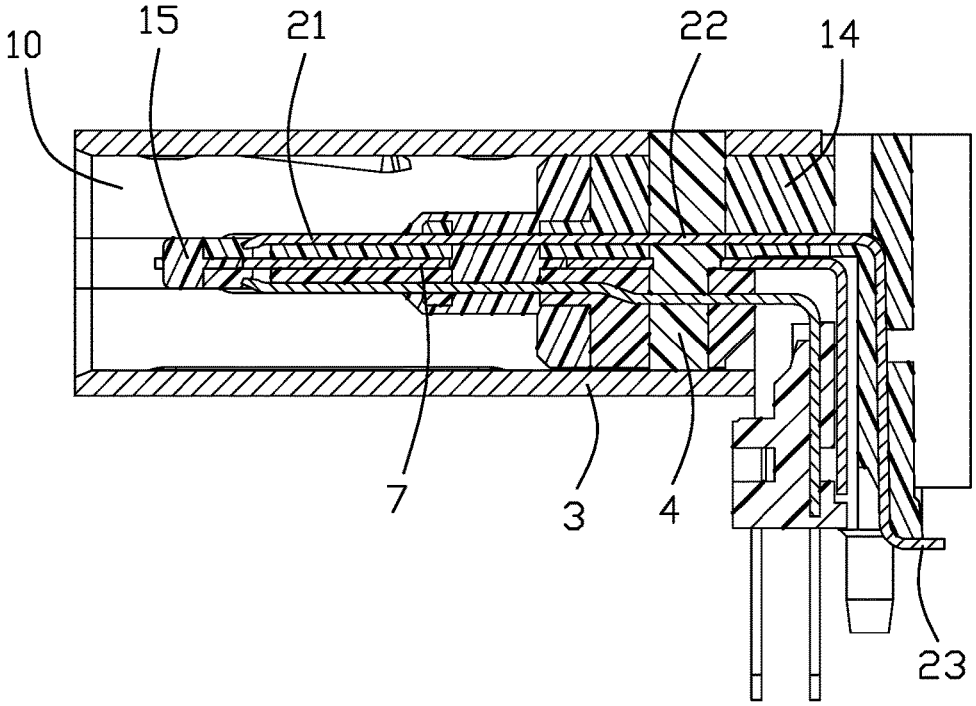
FIG. 9 is a side cross-sectional view of the electrical connector of FIG. 1 without the bracket thereof along line 9-9 in FIG. 7.
Figure 10:
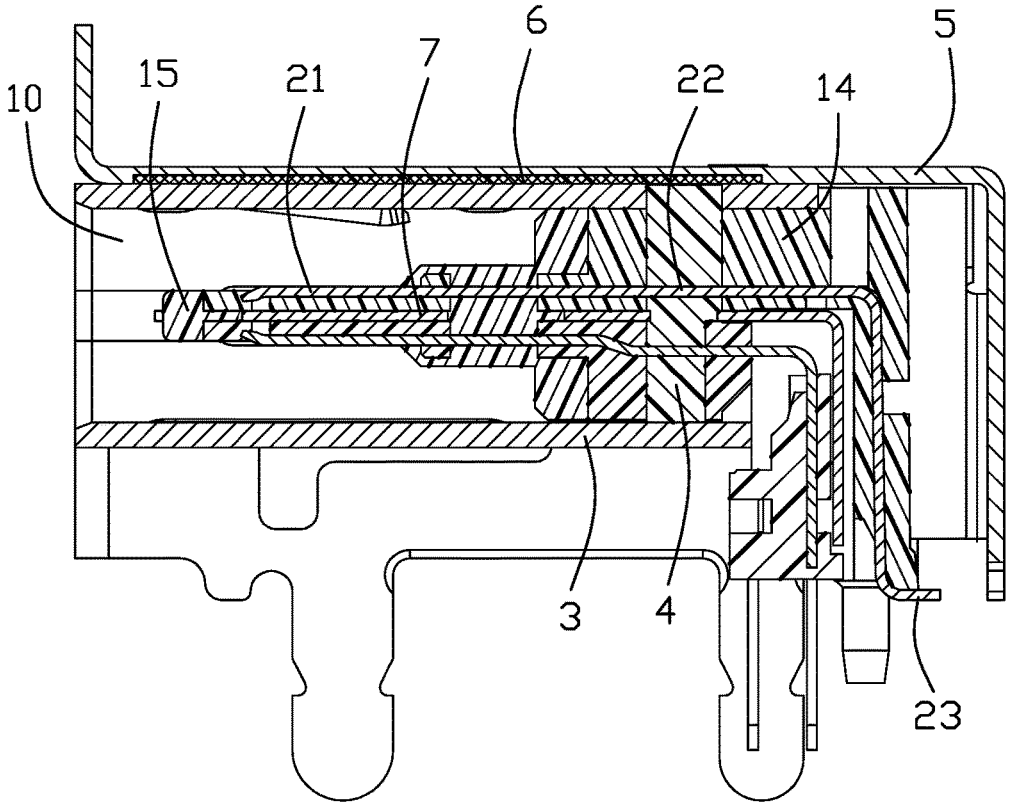
FIG. 10 is a side cross-sectional view of the electrical connector of FIG. 1 with the bracket thereof along line 10-10 in FIG. 1.

Referring to FIGS. 3-4, the insulative housing 1 include a base 14 and a tongue portion 15 forwardly extending from the base 14. The base 14 includes opposite front face 143 and rear face 144 and an annular exterior face 145. The base 14 forms a glue groove 140 which is exposed upon the exterior face 145. The glue groove 140 includes a first groove 141 and a second groove 142 circumferentially surrounding the first groove 141. Further referring to FIG. 9, the tongue portion 15 extends into the mating cavity 10, and the contact 2 includes a contacting section 21 exposed upon the tongue portion 15, a retention section 22 secured within the base 14, and a tail section 23 extending out of the housing 1 wherein a portion of the retention section 22 is exposed in the first groove 141. The second groove 142 forms an open face 1421 around the exterior face 145 of the base 14. In this embodiment, the first groove 141 and the second groove 142 unitarily communicate with each other while maybe being separated from each other. The shielding plate 7 has a portion exposed in the glue groove 140, as shown in FIG. 9.

Referring to FIG. 2, the insulative housing 1 includes a first insulator 11 and a second insulator 12. The contacts 2 include a plurality of first row contact retained in the first insulator 11 via an insert-molding process, and a plurality of second row contacts retained in the second insulator 12 via another insert-molding process. Correspondingly, the glue groove 140 includes a first receiving slot 111 in the first insulator 11, and a second receiving slot 121 in the second insulator 12 to communicate with the first receiving slot 111. The retention section 22 of the first row contact is exposed in the first receiving slot 111, and the retention section 22 of the second row contact is exposed in the second receiving slot 121. The shielding plate 7 is located between the first insulator 11 and the second insulator 12 and includes an opening to communicate the first receiving slot 111 with the second receiving slot 121. The insulative housing 1 further includes a filling part 13 applied upon the assembled first insulator 11, second insulator 12 and shielding plate 7 via an insert-molding process to form the whole terminal module 20.

Figure 5:
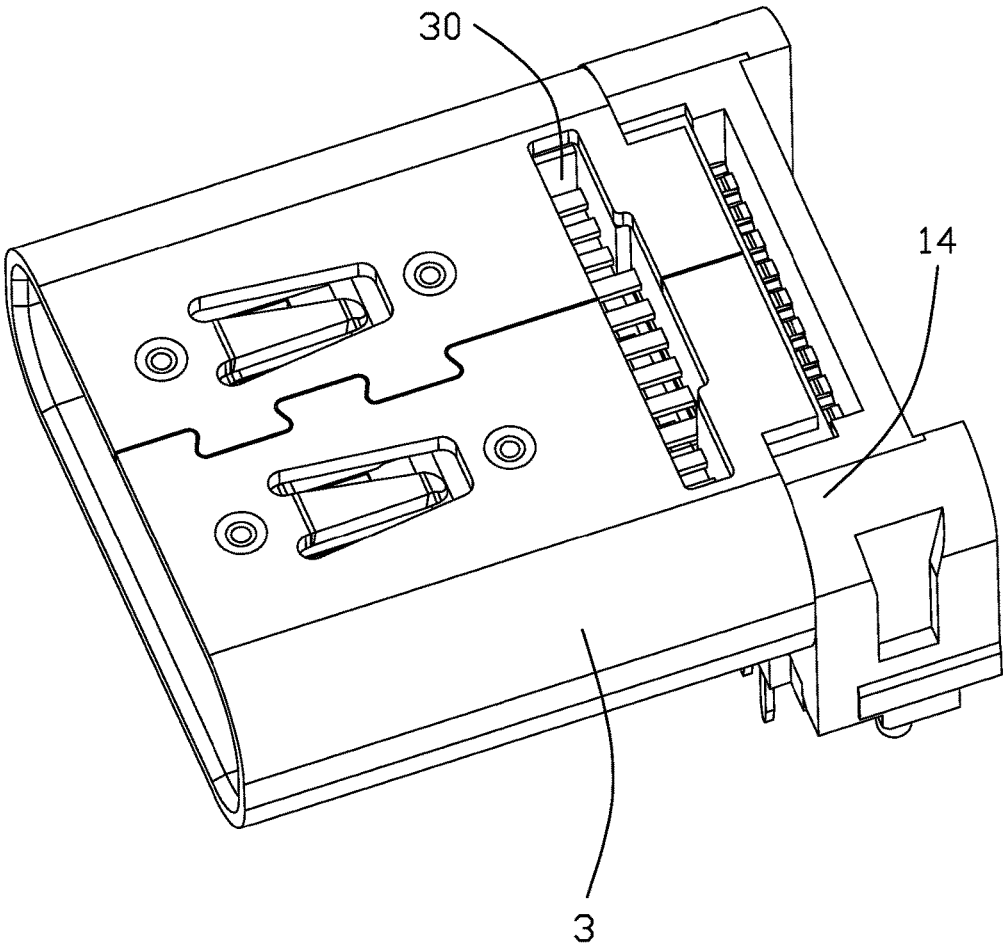
FIG. 5 is a downward assembled perspective view of the sub-assembly of the electrical connector of FIG. 3.
Figure 6:
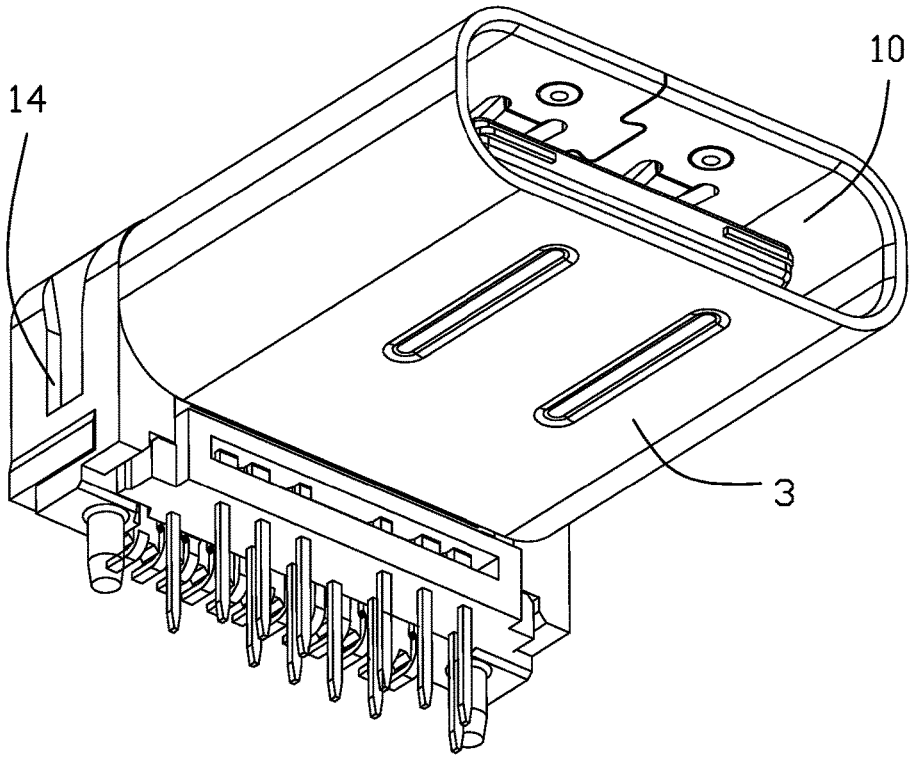
FIG. 6 is an upward assembled perspective view of electrical connector of FIG. 5.
Figure 7:
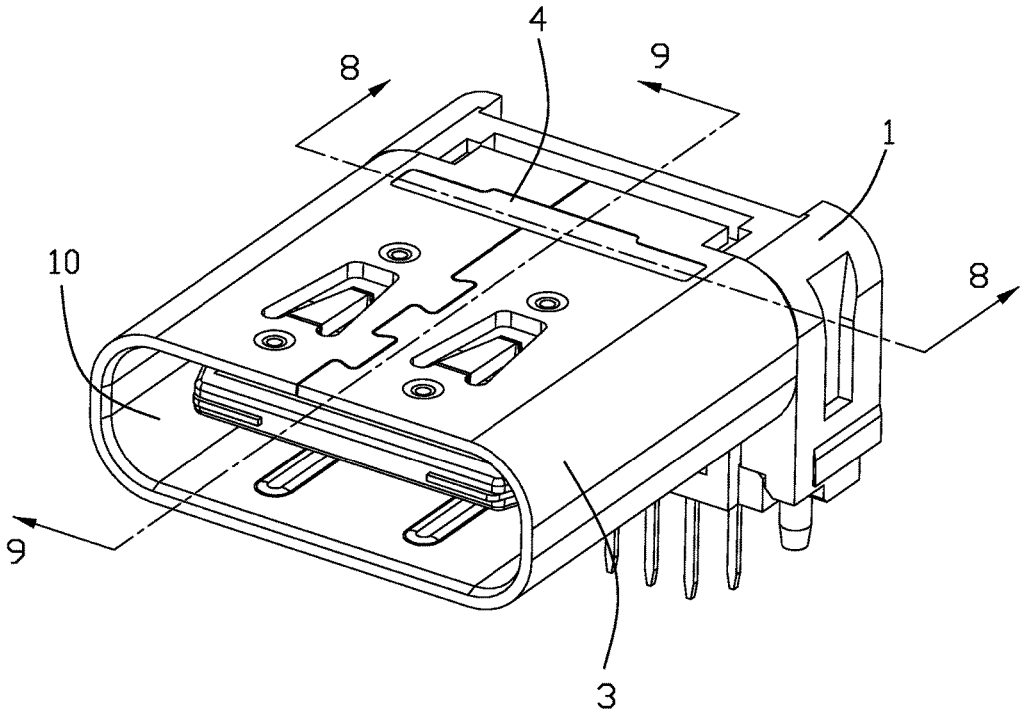
FIG. 7 is another downward assembled perspective view of the terminal module of the electrical connector of FIG. 5.

Referring to FIGS. 5 and 6, the metallic shield 3 encloses the terminal module 20 so as to cover most portions of the open face 1421 while defining an injection opening 30 so as to allow the liquid type glue to enter the glue groove 140 via the injection opening 30. In other words, the glue groove 140 is essentially covered by the shield 3 except at the injection opening 30. Further referring to FIGS. 2 and 7-9, the liquid type glue is injected into the glue groove 140 via the injection opening 30 so as to form a waterproof part 4. The waterproof part 4 includes a first/rectangular sealing section 41 to fill the first groove 141 for enclosing the retention sections 22 of the contacts 2, and a second/annular sealing section 42 to fill the second groove 142 for occupying gaps between the shield 3 and the insulative housing 1, and a third sealing section 43 to fill the injection opening 30. The first sealing section 41. The first sealing section 41 fills the opening 70 which is located in the first groove 141.

The shield 3 includes a seam 31 and the openings 32 due to forming the spring tangs 33. The injection opening 30 is formed in the shield 3 in alignment with the glue groove 140 so as to allow the liquid type glue to enter the glue groove 140. A film 6 is applied upon the shield 3 to veil the seam 31 and the openings 32. The metallic bracket 5 welded upon the shield 3, includes mounting legs 51 for mounting to the printed circuit board so as to have the shield 3 equipped without the mounting legs and the corresponding opening where the mounting legs are derived, for keeping superior shielding function wholly. Notably, the bracket 5 covers the top face of the shield 3 including the opening 30.

In brief, through injection opening 30, the liquid type glue can enter the glue groove 140 to form the waterproof part 4 when the connector 100 is held in a normal horizontal orientation rather than an upside-down vertical manner. Understandably, the waterproof part 4 may be efficiently formed with its final complete configuration via its own gravity in a vertical direction. This glue injection method is significantly different from the traditional way in which the glue is injected into the corresponding glue groove via an opening located around a rear end of the housing with the whole connector is held in an upside-down vertical manner. Notably, in the invention the glue groove does not rearwardly communicate with an exterior via a rear opening but vertically communicating with the exterior via an upper opening. In other words, in the invention the glue groove 140 is essentially confined in the front-to-back direction to regulate the corresponding shape of the waterproof part 4 efficiently, compared with the traditional waterproof part used in the Micro USB connector having a large opening around the rear end of the housing which can not efficiently regulate or confine the rear side/face of the waterproof part. From a technically viewpoint, the flow path of the liquid type glue in the invention is shorter than that in the traditional method, thus being easy to control.

Figure 8:
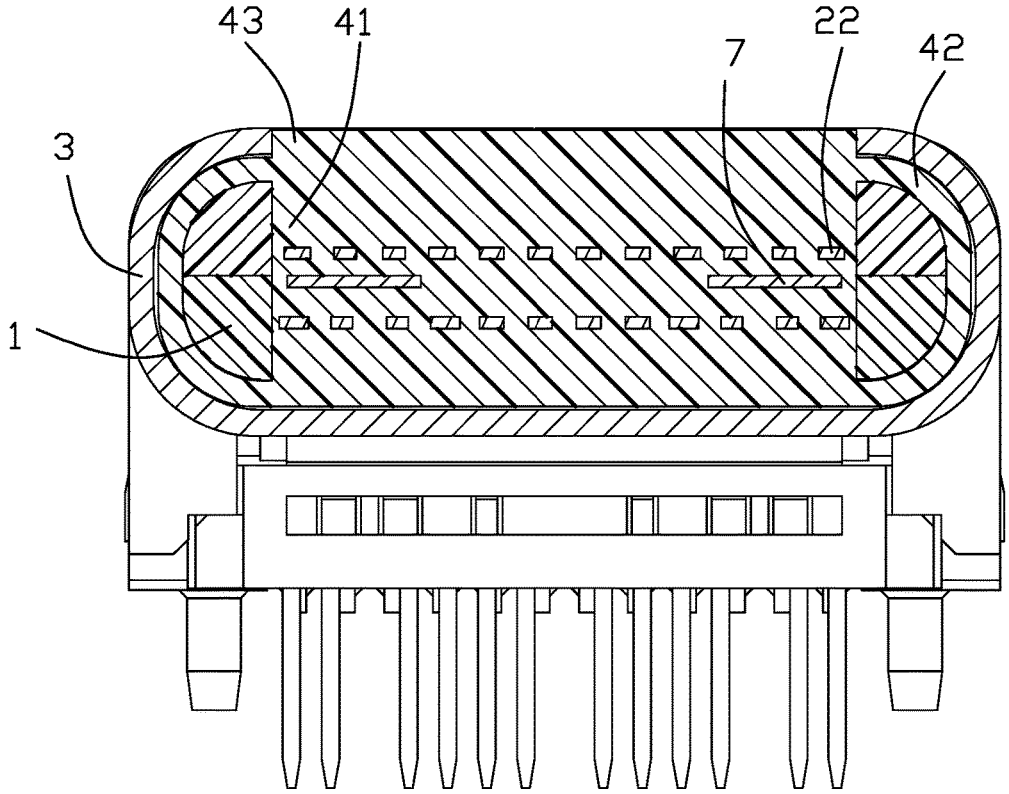
FIG. 8 is a front cross-sectional view of the electrical connector of FIG. 1 without the bracket thereof along line 8-8 in FIG. 7.

In this embodiment, as show in FIG. 8 the first/rectangular sealing section 41 is essentially retained with the retention sections 22 of the contacts 2 while the second/annular sealing section 42 cooperates with the first/rectangular sealing section 41 to grasp the insulative housing 1 and adheres to an interior surface of the shield 3. The opening 70 in the shielding plate 7 facilitates the liquid type glue to enter the second receiving slot 121 in the second insulator 12 via the first receiving slot 111 instead of via the second groove 142.

However, the disclosure is illustrative only, changes may be made in detail, especially in matter of shape, size, and arrangement of sections within the principles of the invention.

What is claimed is:

1. An electrical connector comprising:

a terminal module including an insulative housing with two rows of contacts and a metallic shielding plate integrally formed within the housing;

the insulative housing including a base and tongue portion forwardly extending from the base along a front-to-back direction;

the base defining opposite front and rear faces in said front-to-back direction;

a glue groove formed in the base, and located between and spaced from said front face and said rear face in the front-to-back direction;

each of said contacts including a retention section exposed in the glue groove; and a tubular metallic shield enclosing the terminal module and defining a mating cavity in front of the front face; wherein the shield forms an injection opening generally aligned with the glue groove in a vertical direction perpendicular to said front-to-back direction so as to allow liquid type glue to enter and fill the glue groove via said injection opening to form a waterproof part, wherein the glue groove includes a first groove in which a first sealing section of the waterproof part is received to retain the retention sections of the contacts, and a second groove surrounding the first groove in which a second sealing section of the waterproof part is received to intimately contact an interior surface of the shield; wherein said second sealing section of the waterproof part circumferentially surrounds a portion of the housing; wherein the shielding plate includes an opening aligned with the glue groove in the vertical direction and occupied by the waterproof part; wherein the injection opening is occupied by the waterproof part; further including a metallic bracket attached upon the shield to cover the injection opening.

2. The electrical connector as claimed in claim 1, wherein said bracket includes a mounting leg for mounting to a printed circuit board while the shield has no mounting leg for mounting to the printed circuit board.

3. A method of making an electrical connector comprising steps of:

providing a terminal module with an insulative housing and a plurality of contacts retained in the housing;

providing the insulative housing with a base and a tongue portion extending forwardly from the base in a front-to-back direction;

providing said base with opposite front and rear faces, and a glue groove located between the opposite front and rear faces in the front-to-back direction;

assembling a metallic tubular shield upon the terminal module with therein an opening in communication with the glue groove; and injecting liquid type glue into the glue groove via an injection opening to form a waterproof part in said glue groove, wherein said injection opening communicates with the glue groove in a transverse direction perpendicular to said front-to-back direction; wherein said transverse direction is a vertical direction; further including a step of welding a metallic bracket upon the shield to cover said injection opening; wherein said bracket is equipped with at least one mounting leg for mounting to a printed circuit board while said shield is equipped with no mounting legs; wherein said liquid type glue is injected into the glue groove when the connector is held in a normal horizontal manner along said front-to-back direction; further including a step of providing a metallic shield in the insulative housing, wherein said shielding plate has an opening intersecting with the glue groove and filled with the waterproof part.

4. An electrical connector comprising:

a terminal module including an insulative housing with a plurality of contacts therein;

a metallic shield enclosing the terminal module to form a mating cavity forwardly communicating with an exterior in a front-to-back direction; and a glue groove formed in the insulative housing and in communication with an exterior in a transverse direction perpendicular to said front-to-back direction; wherein said shield includes an injection opening in communication with said the glue groove in said transverse direction so as to allow a liquid type glue to enter the glue groove to form a waterproof part, wherein said injection opening is aligned with the glue groove in a vertical direction; further including a metallic bracket attached upon a top face of the shield to cover the injection opening; wherein said contacts include retention sections exposed in the glue groove and enclosed by the waterproof part; wherein said waterproof part includes two opposite front and rear surfaces both intimately confronting the insulative housing in the front-to-back direction; wherein said injection opening is occupied by the waterproof part.

* * * * *